US006834417B1

(12) United States Patent
Buchmüller

(10) Patent No.: US 6,834,417 B1
(45) Date of Patent: Dec. 28, 2004

(54) METHOD AND DEVICE FOR PROCESSING FILAMENT YARN, AND USE OF SAID DEVICE

(75) Inventor: Patrick Buchmüller, Krummenau (CH)

(73) Assignee: Heberlein Fibertechnology, Inc., Wattwil (CH)

( * ) Notice: Subject to any disclaimer, the term of this patent is extended or adjusted under 35 U.S.C. 154(b) by 0 days.

(21) Appl. No.: 09/914,572

(22) PCT Filed: Mar. 3, 2000

(86) PCT No.: PCT/CH00/00120

§ 371 (c)(1),
(2), (4) Date: Dec. 26, 2001

(87) PCT Pub. No.: WO00/52240

PCT Pub. Date: Sep. 8, 2000

(30) Foreign Application Priority Data

Mar. 3, 1999 (CH) ..... 390/99

(51) Int. Cl.[7] ..... D02G 1/16
(52) U.S. Cl. ..... 28/271
(58) Field of Search ..... 28/271, 272, 273, 28/274, 275, 276

(56) References Cited

U.S. PATENT DOCUMENTS 3,577,615 A * 5/1971 LeNoir ..... 28/271
3,730,413 A * 5/1973 McDermott et al. ..... 28/272
3,783,596 A * 1/1974 Waldkirch ..... 57/296
4,214,352 A 7/1980 Pavek et al.
4,253,299 A * 3/1981 Borenstein et al. ..... 57/246
4,934,133 A * 6/1990 Stalder et al. ..... 57/333
5,010,631 A 4/1991 Ritter
5,146,660 A 9/1992 Ritter
5,275,618 A * 1/1994 Koyfman et al. ..... 606/228
5,423,859 A * 6/1995 Koyfman et al. ..... 606/228
5,688,451 A * 11/1997 Hutton ..... 264/103
5,964,015 A * 10/1999 Sear ..... 28/274

FOREIGN PATENT DOCUMENTS

DE 41 02790 8/1991
DE 4102790 A1 * 8/1991 ..... B65H/51/16
DE 41 13927 11/1992
DE 195 46784 6/1997
EP 0 465 407 A1 1/1992
EP 0 564 400 A1 10/1993

* cited by examiner

*Primary Examiner*—John J. Calvert
*Assistant Examiner*—Shawn R Hurley
(74) *Attorney, Agent, or Firm*—Finnegan, Henderson, Farabow, Garrett & Dunner, L.L.P.

(57) ABSTRACT

A method of treating filament yarn includes supplying a plurality of yarn filaments through a yarn channel of a nozzle in a yarn travel direction and introducing a blowing medium into the yarn channel substantially in a direction of the yarn travel direction and at an angle of introduction of more than about 15° and less than about 45° from a direction perpendicular to the yarn travel direction. The plurality of yarn filaments are mixed within the yarn channel so as to produce a filament yarn substantially free of knits.

27 Claims, 8 Drawing Sheets

Figure 1:
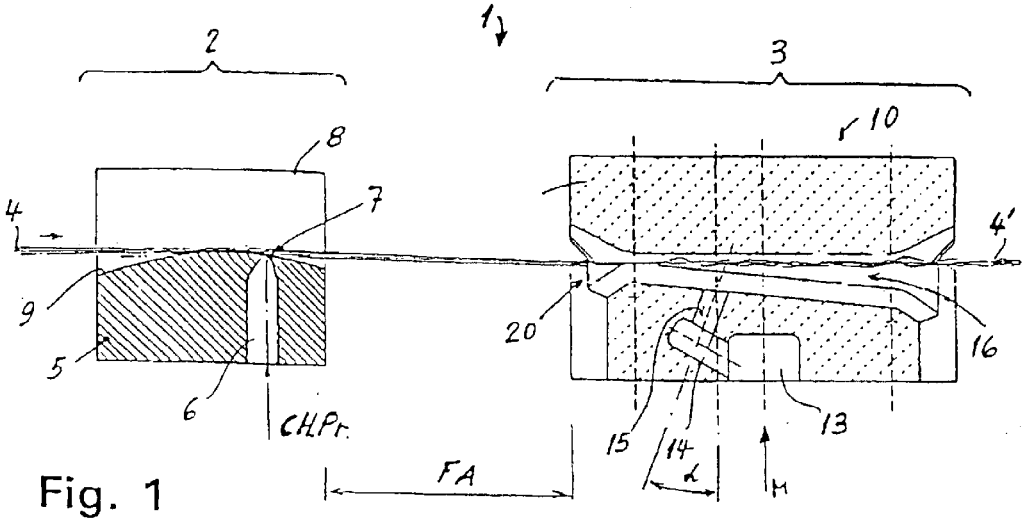

POY
FDY 50
2
(60)
3
(3)
54
55
Heat
DR.TW.
DR. W.

BCF

Techn. Yarn

METHOD AND DEVICE FOR PROCESSING FILAMENT YARN, AND USE OF SAID DEVICE

TECHNICAL SCOPE

This invention relates to a method and a device for treatment of filament yarn in a yarn channel of a nozzle with a supply of blowing medium into the yarn channel.

STATE OF THE ART

Treatment of continuous filament yarn has mainly two functions. First, a textile character and technical textile properties are to be imparted to the yarn which is produced from filaments synthesized industrially. Secondly, the yarn is treated from the standpoint of specific quality features for further processing and/or for the end product. To some extent, grades of yarn must be manufactured that are not necessary and cannot be achieved with products produced from natural fibers. The fields of application are in industrial processing of textiles, e.g., for the construction sector, the automotive sector as well as for carpet production and for special textile products for use in the sports and leisure industries. Furthermore, spun yarn is to be treated for the best possible industrial processing by applying of certain preparations, and the processing operation is to be optimized for yarns and fabrics. Optimization in this sense also includes maintaining or increasing certain quality criteria and lowering production costs, even with respect to downtime along the entire processing route.

Various treatments such as preparation and finishing of yarn by way of yarn treatment nozzles are an important part of filament spinning. The change in structure from a smooth yarn to a textured or interlaced yarn is achieved by means of mechanical air forces. In the case of texturing, a textile character is to be imparted to the smooth yarn. Small loops in the filaments are produced with a supersonic flow, and thus a greater volume is achieved over the entire yarn. In interlacing, knots are formed in the yarn at short intervals, increasing cohesion of the yarn and imparting more stable running of the yarn in processing and in spooling. Air treatment nozzles are used to improve the structure of a yarn. One very demanding process is the improvement in quality by treatment with superheated steam, e.g., for relaxing a yarn as part of a drawing operation or after a previous process measure. In all cases, the nozzle bodies are made of a highly wear-resistant material, because otherwise their lifetime would be too short. The preparation step is a not insignificant source of problems for yarn treatment nozzles. In this process, yarn is provided with protective substances immediately after the spinning operation or after production of individual filaments. These protective substances should be of assistance in subsequent processing. The substances used for this preparation step result in an oily lubricant property, so that the sliding friction of the yarn remains as low as possible over the entire path of processing, the risk of damage and yarn breakage is reduced, and abrasion on the friction surfaces of the conveyance and processing installations can be minimized. However, there are a number of other factors such as static charge buildup on which the preparation or preparation agent can have a positive influence. Another field of application is for protection of yarn from fungal attack during storage times between the various processing stages.

The drawing operation is another very important process step for filament yarn. After filaments leave the spinnerets, the yarns formed from them must be drawn. This drawing presupposes that the yarn is more or less smooth, although that is no longer the case when processing a textured yarn. In a great many applications, there is a need for imparting a minimal interconnection to the yarn. However, this interconnection may only be intense enough so that it does not have a negative effect on downstream processing operations. It is known that an intermingling nozzle can be arranged downstream from the site of application of preparation agents in a spinning operation. In this case, only very weak knots are formed in the yarn, or even better, only the beginnings of knots are formed to stabilize the transport operations which follow directly. One disadvantage here is finding optimum conditions or an optimum compromise between no knots at all and just the beginnings of knots. The intermingling nozzles known so far are characterized by poor utilization of the air treatment or a weak eddy formation, especially with a relatively low pressure of the processing air. In practice, the uniformity and constancy of the resulting yarn structure often suffer. In the state of the art there is no stable yarn treatment option or a corresponding device which produces enough filament interconnection that calm and stable yarn running is assured without any negative effects on downstream procedures or process stages or with respect to structural changes.

German Patent 41 02 790 describes a special problem in regard to false twist crimping machines and proposes a delivery nozzle. To this end, the delivery air is blown into the nozzle channel at an angle of 20° to the direction of yarn travel, for example. In the case of a delivery effect almost exclusively, the yarn remains almost unchanged. U.S. Pat. No. 4,214,352 proposes a texturing nozzle for production of a looped yarn. An angle of approx. 45° for introduction is mentioned.

EXPLANATION OF THE INVENTION

The object of this invention was to develop a method as well as yarn treatment nozzles which would permit prebonding of the yarn interconnection, in particular with the greatest possible constancy of a gentle structural operation. The goal was to produce the interconnection even at the highest speeds of yarn transport, e.g., at speeds of 3000–7000 m/min, directly downstream from the spinnerets and in direct conjunction with the application of preparation agents. Part of the object of this invention was to improve the situation for treatment of yarn from the standpoint of preparation agents, productivity, especially quality, even at the highest speeds.

The method according to this invention is characterized in that the blowing medium is directed into the yarn channel somewhat in the direction of thread travel and at an angle of introduction with an angle deviation $\alpha$ from the perpendicular to the direction of thread travel, said angle deviation being greater than 15° but less than 45°, with the filaments of the prepared yarn being blended and slightly crossed without producing knots.

The device according to this invention is characterized in that the device is designed as a migration nozzle having a compressed air feed channel into the yarn channel, said compressed air feed channel being aimed in the direction of yarn travel and arranged in the yarn channel with an angle deviation greater than 15° but less than 45° from a perpendicular to the direction of yarn travel.

This invention also relates to the use of this device for thorough mixing and uniform distribution of preparation agents on filament yarn, whereby the filaments are joined to form a slightly crossed but knot-free yarn, and the preparation agent is at the same time distributed optimally over the entire yarn.

This invention permits a large number of especially advantageous embodiments. In this regard, reference is made to claims 2 through 10 and 12 through 16.

Practice has shown that with an increase in yarn transport speed, namely to more than 3500 m/min in the case of polyester, for example, more than 3000 m/min in the case of polypropylene and more than 4200 m/min in the case of polyamide, thread running becomes unstable and erratic despite the preparation. This instability increases further with any further increase in spinning yarn speed. This becomes problematical in the case of higher multi-end spinning positions. This is true in particular of deflection rollers and drawing rollers in pre-oriented POY and finished-oriented FOY as well as fully drawn FDY spinning operations. Another factor is that a progressively smaller separation between adjacent yarn runs is desired, not least of all for reasons pertaining to mechanical engineering and the process technology, so that with the same machine depth which would previously accommodate four yarn runs, the desired goal today is eight to ten. With a smaller separation, there is an increased risk of skipping of filaments from adjacent yarn runs, which could then immediately cause a thread break. Not least of all for ecological reasons but also for economic reasons, it is impossible to increase the application of preparation agents to an unlimited extent through contact with the preparation lips accordingly.

All experiments so far have shown that the range up to 15° represents a barrier for the angle of introduction of blowing air into the yarn channel or on the longitudinal middle axis LM of an intermingling nozzle. In most cases the air jet is directed at right angles onto the longitudinal middle axis in the case of intermingling nozzles, to produce two uniform eddies in the yarn channel. All experience so far has shown that the greater the inclination of the direction of the blowing air, e.g., in the range of about 10° to approximately 15° to a perpendicular line with respect to the yarn run, the greater the conveyance component of the air and thus the more the intermingling nozzle will lose its actual function, namely that of producing intermingling knots. Therefore, in those cases in which a certain air treatment was sought in the manner of the intermingling nozzles but without forming knots in the yarn, it seemed obvious to use an intermingling nozzle from the state of the art but to simply lower the air pressure until, for lack of energy, the compressed air could no longer form knots. One disadvantage of this was that the reproducibility of the results left much to be desired.

Systematic experimental series with this novel invention have surprisingly shown that new effects occur with a suitable adjustment of the blowing air pressure in the range of angles of introduction of more than 15°, namely there is a slight crossing of filaments with a corresponding mixing effect. The actual surprise found in our own experiments was that in the case of prior application of preparation agent to the yarn, this preparation agent would be optimally distributed on the yarn or the individual filaments and in particular the effect of the preparation agent would be significantly greater even with a reduction of 5% to 20% in the amount of preparation agent in comparison with the known practice. Smooth running, stability and a greater operating reliability can be achieved with this new solution. Thus, in many cases this makes it possible to save on preparation agent in the amount of 10–20% or more. There are many possible applications. It was very soon found that the effect of slight crossing would not interfere with any of the downstream treatment stages, e.g., neither drawing nor production of a knotted yarn or thermal effects such as relaxation would cause any interference. This novel invention thus fulfills a double function for use of the preparation agent, namely crossing and optimizing the application and distribution of the preparation agent. Due to the fact a strong conveyance effect is imparted to the air stream in the direction of yarn travel, it is possible not only to increase the yarn transport speed but also to increase the effect of the air in the sense of creating intense air eddies without producing knots. This therefore makes available for actual practice a novel element having some very positive effects that were not possible in this way in the past and it permits a variety of possible applications. In the predominant majority of application cases, air is the optimum blowing medium. However, it has been found that steam can also be used as the medium in special applications, e.g., for relaxation. This novel process step is referred to below as the migration step, and the novel air nozzle is referred to as the migration nozzle.

In POY and FOY/FDY spinning operations, the thread run is calmer with an additional migration step. There is a stabilizing effect of the thread on the downstream deflection rollers or drawing rollers, not least of all due to the more uniform distribution of spinning preparation between the filaments and thus also due to compensation of differences in thread tension. This takes place as described below, depending on the spinning operation:

In the FOY/FDY process, the thread is stabilized on the drawing rollers and the deflection rollers due to a more uniform distribution of the spinning preparation in the thread and a slight mingling of the filaments (a type of continuous intermingling without knotting). There must not be any intermingling points, because they would lead to differences in friction on the drawing rollers in the drawing operation. The migration nozzle is located upstream from the first drawing roller. If intermingling is necessary, it is performed upstream from the spooler with an additional air intermingling nozzle.

In the POY process, the goal is also stabilization of the thread on the rollers (deflection rollers here) through a more uniform distribution of spinning preparation between the filaments. The installation position is the same.

In the BCF process, individual filaments in the yarn are stabilized and the preparation is distributed. In the tricolor process, a slight color separation in the yarn is also achieved. The installation position is the same as that with the other processes.

The stream of blowing air is preferably produced with compressed air of less than 6 bar, preferably less than 1.5 bar, especially preferably from 0.3 bar to 1.2 bar. In the case of finer yarns, a pressure of approximately 0.5 bar has proven to be optimum. By means of the migration nozzle, a new method which was not known in previous practice is implemented with the crossing of the filaments. The most proximate art is intermingling. In intermingling, a blending and interconnection of the individual filaments of a yarn is sought; this can be discerned by visible knots in the product. In migration, no knots should be formed; this is achieved on the one hand by an angle of introduction of more than 15°, preferably 20° to 60°, especially less than 45°, and on the other hand also with a lower pressure of the treatment air. Instead of forming knots, only a blending and crossing of the filaments are desired. The stream of air aimed in the direction of yarn travel has a sufficiently intense distribution and mixing function for the preparation agent in the yarn channel. The preparation agent is distributed much more uniformly over the entire yarn by means of the eddy current and the very intense movement of filaments relative to one another due to local whirling and frictional movements of the filaments, resulting in an obviously more stable thread running with a very good interconnection effect for the filaments of a yarn, even at the highest yarn conveyance speeds in effect today. The above-mentioned skipping effect was no longer detected after use of this novel invention, so that the risk of thread breakage can be reduced significantly. Treatment in the migration nozzle as part of the spinning operation preferably takes place immediately after preparation at very high yarn transport speeds.

The migration nozzle has a continuous treatment channel which widens in the direction of thread running in many applications, with a supply of compressed air aimed into the yarn channel in the direction of transport, opening into the yarn channel with a deviation of more than 15° from a perpendicular line. The migration nozzle is arranged at a free distance directly downstream from a device for applying preparation agents. The effective yarn channel length is preferably designed so that it widens steadily, with the smallest cross section being in the area of the yarn feed and the largest cross section being in the area of the yarn draw-off from the yarn channel of the migration nozzle. Experiments so far have shown that good results are achieved when the ratio of the inlet cross section to the outlet cross section is approximately 1:2. The air feed opens approximately at the end of the first third of the treatment channel. The migration nozzle preferably has a threading slot over the length of the yarn channel, preferably arranged in the upper third of the yarn channel in the plane of separation between the nozzle plate and the baffle plate. The migration nozzle may be designed as a single nozzle, a double nozzle or a multiple nozzle.

Instead of the migration nozzle, the same nozzle or a slightly modified nozzle may also be used for relaxation, in which case steam is required instead of compressed air. Depending on the application, the nozzle may be used as a closed nozzle or as an open nozzle having a threading slot.

The inventors have recognized the fact that a nozzle with connecting means remains reliable in operation only if the nozzle can withstand pressure, heat, steam and chemicals. Not all problems encountered in practice have been solved satisfactorily with the glue joints used in the past. Glue joints can also be investigated only inasmuch as the practical connections are already known. However, the composition of a glue joint cannot be stipulated with regard to attack by as yet unknown chemicals to be used in the future, not to mention the additional effects of heat and moisture. Preferably the connecting means in the novel solution are arranged in the same alignment, preferably aligned so they are flush with the yarn travel. It has surprisingly been found with a corresponding pin connection that the entire nozzle body can be designed to be much smaller, even in miniaturized form in comparison with the state of the art. Especially in the case of use of a double nozzle or multiple nozzles side by side, the separation between two adjacent yarn runs can be selected to be much smaller than in the past. In some applications, this even has a feedback effect on the size of the godet rollers. Due to the possibility of miniaturization, additional yarn runs can be provided on the same machine size, thanks to this novel connection, and the total output of the machine can be increased accordingly. This means that the connection means which is otherwise used in clock and watch technology brings unexpected advantages in an entirely different area. The forced cohesion of the parts can be ensured by a traditional screw connection, as in the state of the art. This novel embodiment is especially advantageous in the application as an intermingling nozzle and as a thermal treatment body, and it is very advantageous when used as a migration nozzle, as will be explained below.

In agreement with the known intermingling nozzles, the treatment medium is directed at the longitudinal center axis of the yarn channel with the greatest possible accuracy, but with an inclination of more than 15° in the yarn transport direction. This produces uniform eddies on both sides but no knots.

BRIEF DESCRIPTION OF THE INVENTION

Figure 2A:
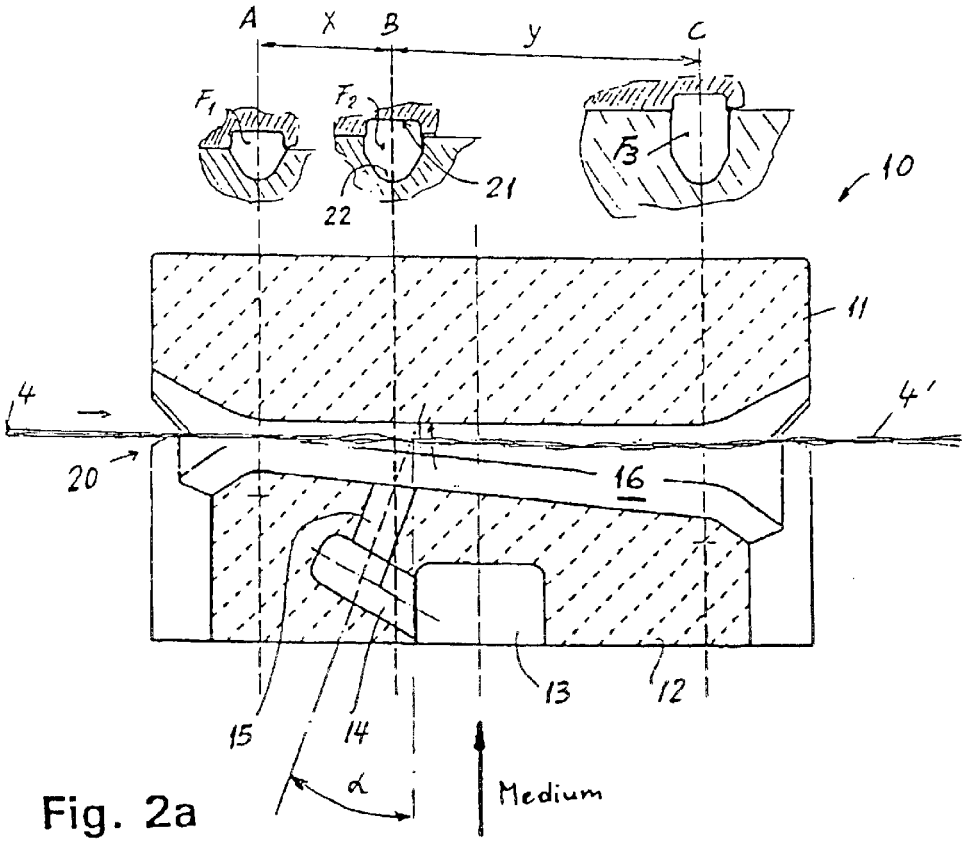
Figure 2B:
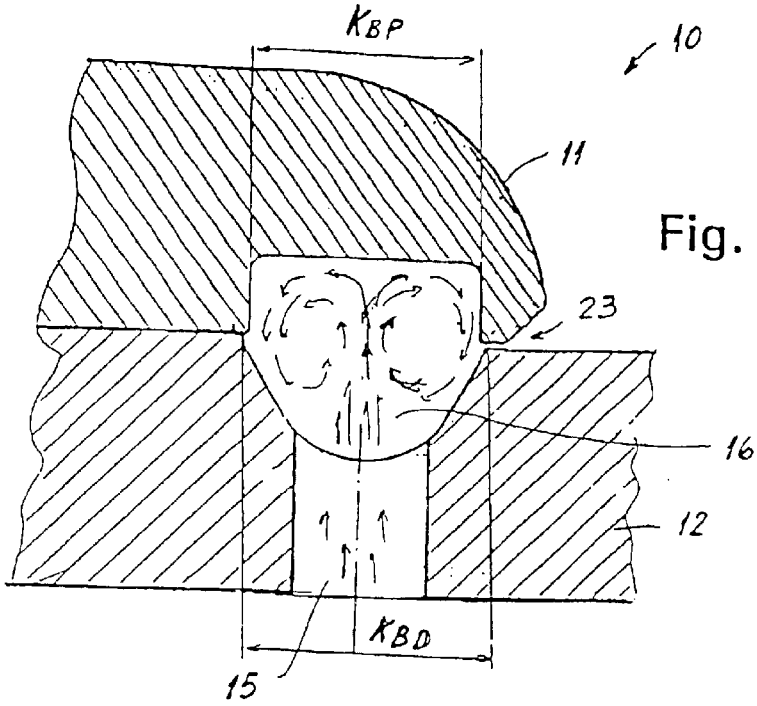
Figure 2C:
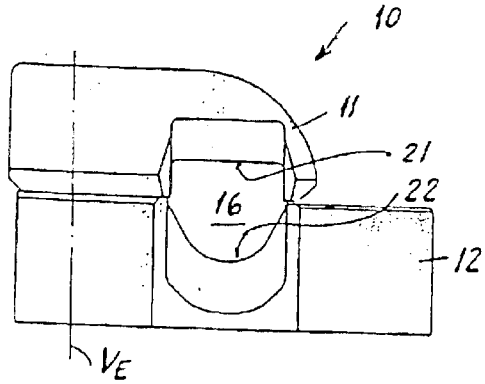

This novel invention is explained below on the basis of several embodiments with additional details, showing in great enlargement:

FIG. 1: a preparation with a migration nozzle connected to it, each shown in a sectional view;

FIG. 2*a*: the migration nozzle from FIG. 1 on a larger scale;

FIG. 2*b*: the air intermingling flow in the yarn channel;

FIG. 2*c*: a single migration nozzle and

Figure 2D:
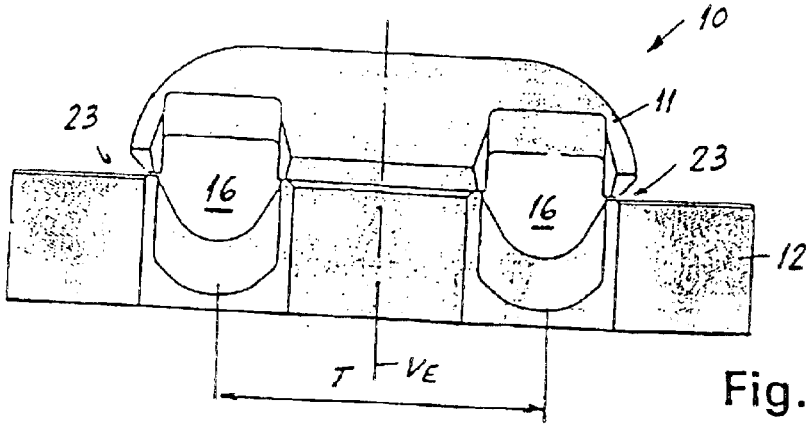
Figure 3A:
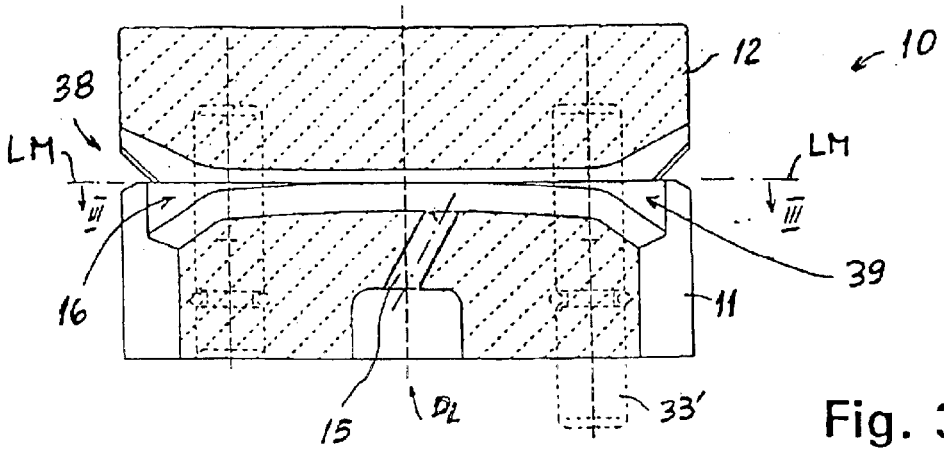
Figure 3B:
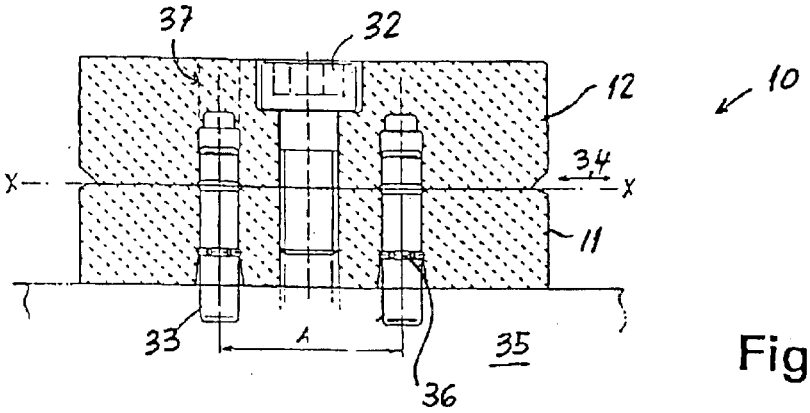
Figure 3C:
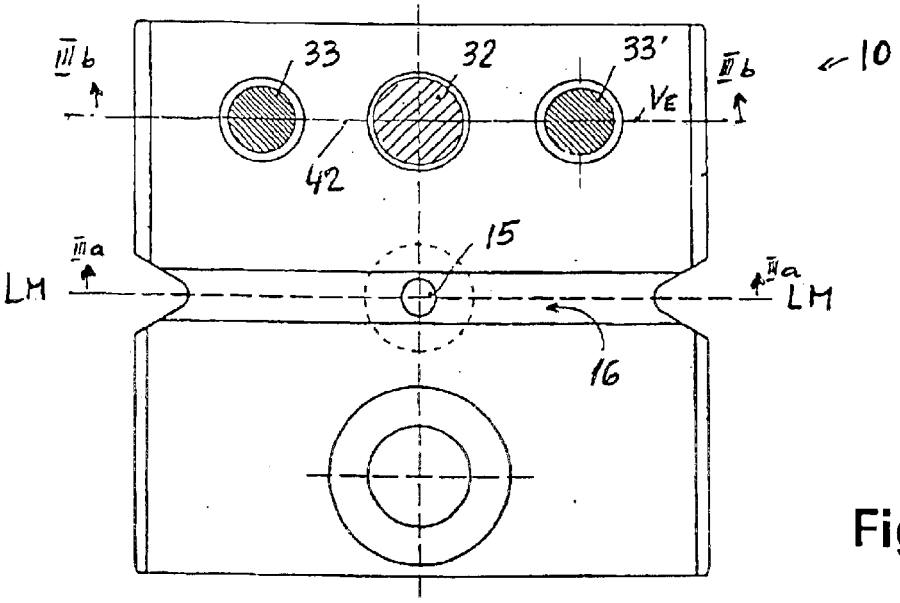
Figure 5C:
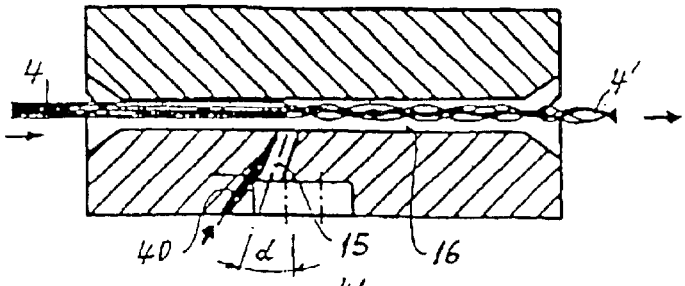
Figure 5B:
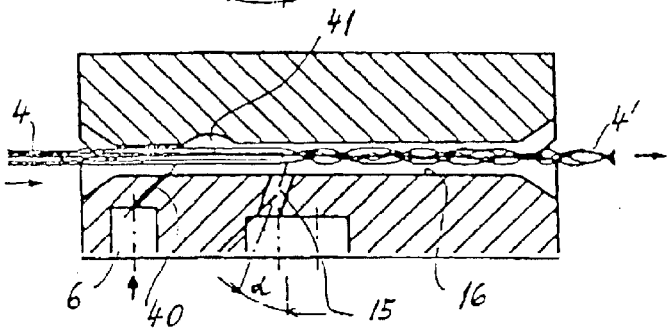
Figure 5A:
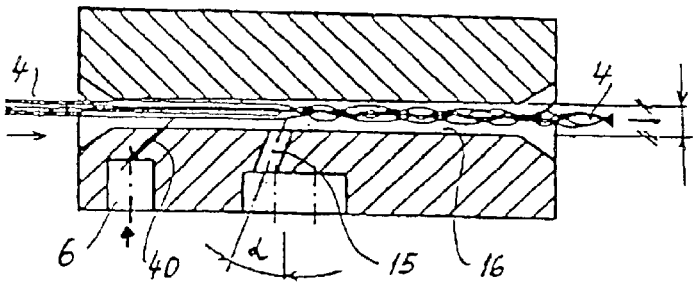
Figure 4B:
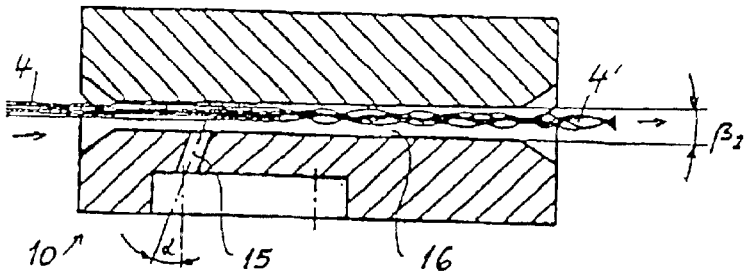
Figure 4A:
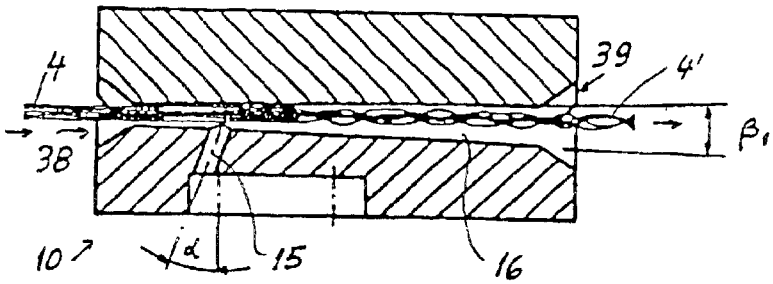
Figure 6A:
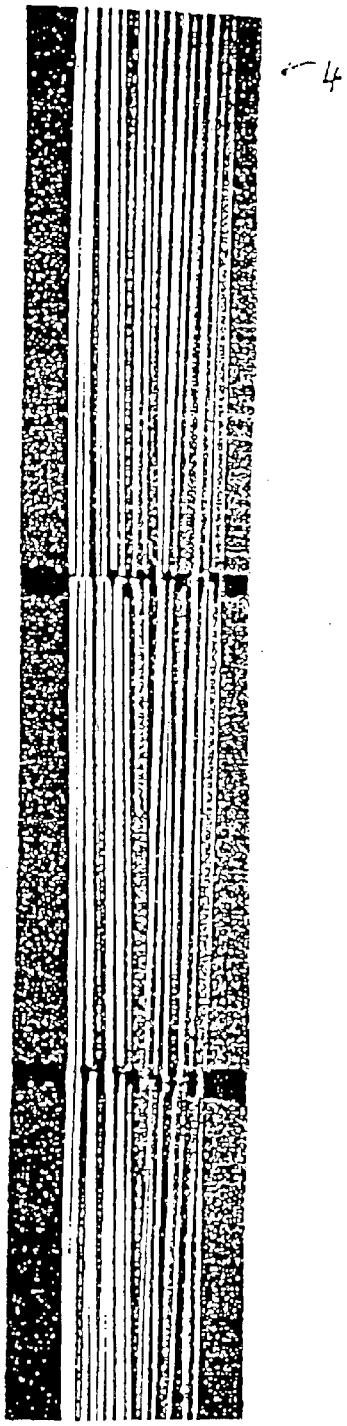
Figure 6B:
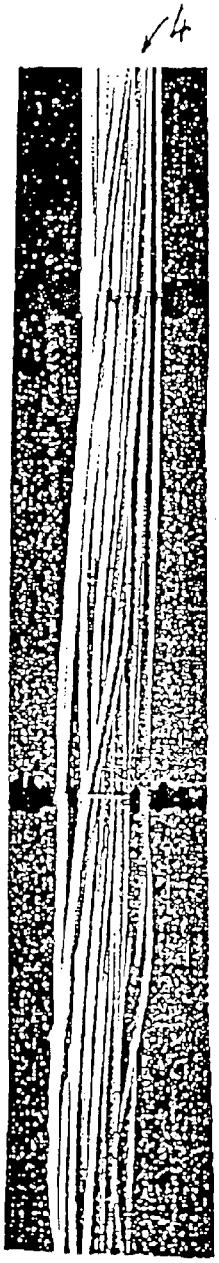
Figure 6C:
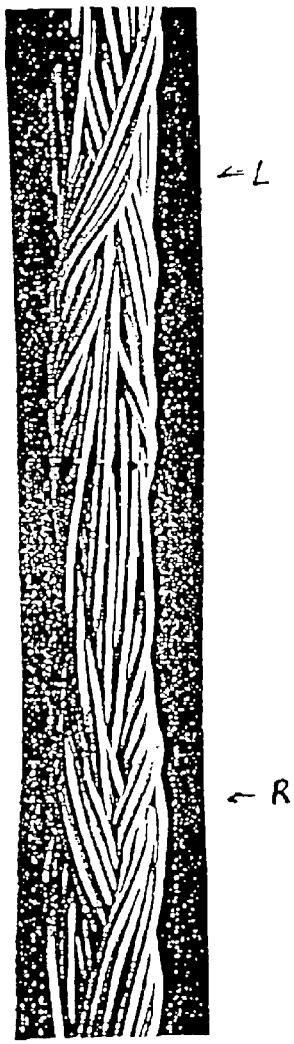
Figures 7A, 7B, 7C:
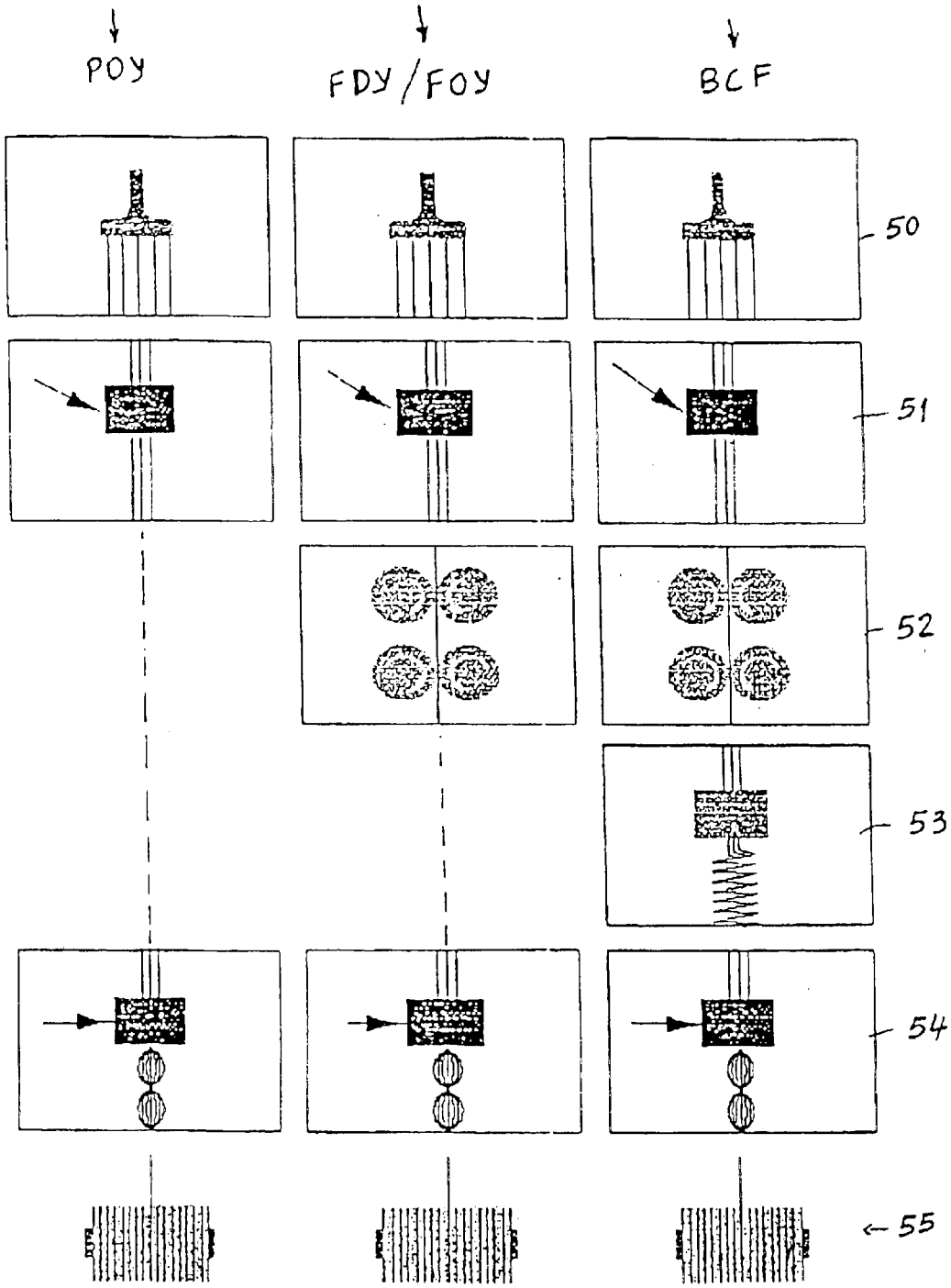
Figures 8A, 8B, 9A, 9B, 9C:
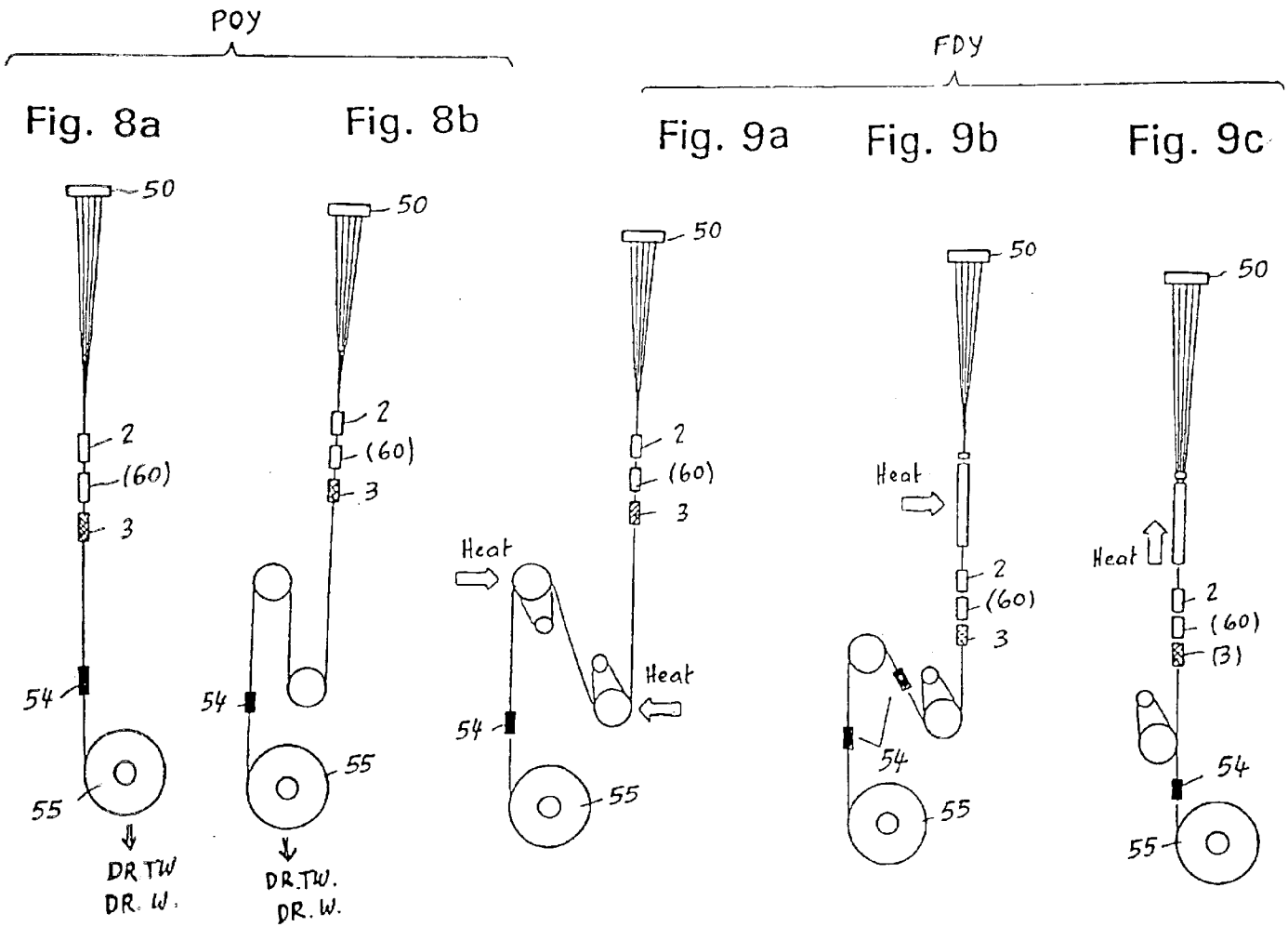
Figure 10B:
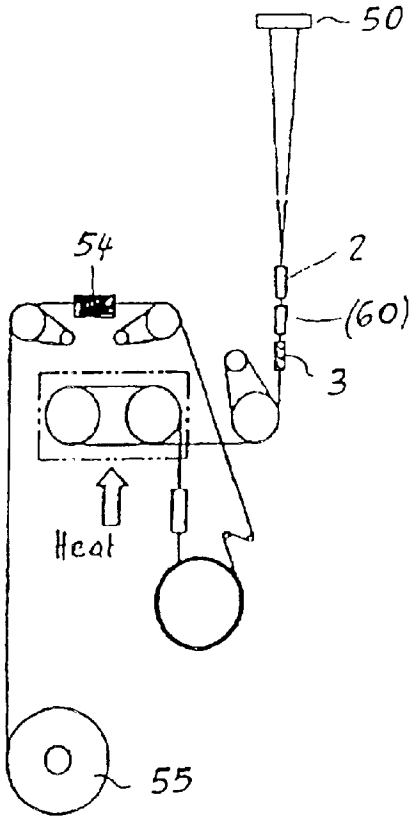
Figure 10A:
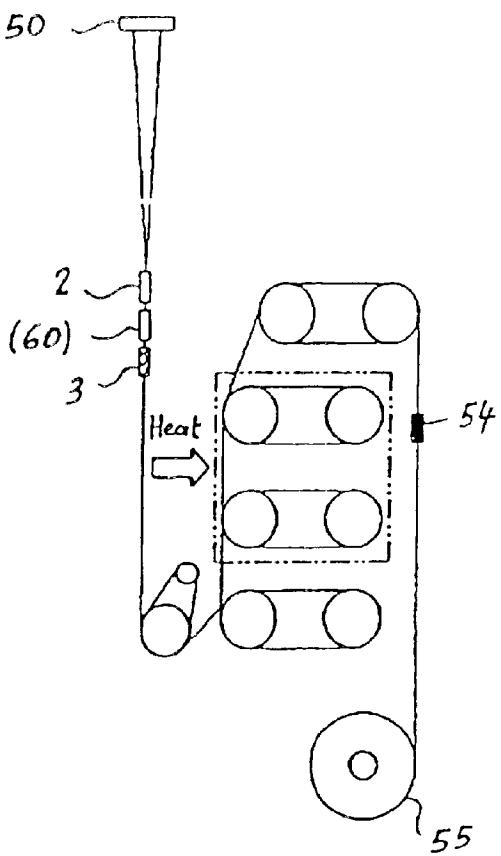

FIG. 2*d*: a double migration nozzle as an open structural design with a threading slot;

FIGS. 3*a*–3*c*: an optimum connection of a divided nozzle with alignment pins;

FIGS. 4*a* and 4*b*: two migration nozzles having different opening angles β of the yarn channel;

FIGS. 5*a*–5*c*: various embodiments of a migration nozzle having an integrated preparation medium feed;

FIG. 6*a*: an enlargement of the untreated smooth yarn;

FIG. 6*b*: smooth yarn with crossing of the filaments;

FIG. 6*c*: intermingled yarn having two typical knots with a left-hand rotation and a right-hand rotation;

FIGS. 7*a*–7*c*: schematically three different areas of application of a migration nozzle as well as an intermingling nozzle of the state of the art;

FIGS. 8*a* and 8*b*: two examples of POY yarn;

FIGS. 9*a*–9*c*: three fields of application for FDY yarn;

FIG. 10*a*: use in technical grade yarns;

FIG. 10*b*: use for BCF yarn.

METHODS AND EXECUTION OF THE INVENTION

FIG. 1 shows a detail of a yarn treatment stage 1, showing the chemical preparation stage 2 at the left and the migration stage 3 at the right. Yarn 4 comes directly from a spinning operation and passes over a preparation device having a base body 5 in which a feed channel for the preparation agent CH,Pr passes from beneath into the area of the thread running and ends with the so-called preparation lips 7. Two guide webs 8 are arranged in a U shape over the preparation lips 7, guiding yarn 4 laterally over the preparation lips 7. The base body 5 preferably has a cambered guide groove 9 such that the thread running is force-guided over the location of contacting of yarn 4 with preparation agents CH,Pr. Application of the preparation agent CH,Pr to yarn 4 then takes place in the manner of an entrainment effect through sliding contact. Since the preparation agent CH,Pr is under pressure in feed channel 6 only inasmuch as a reliable secondary flow is guaranteed, it is impossible to wet all the filaments of the yarn uniformly. As a result, yarn 4 cannot be finished with preparation agents homogeneously by means of preparation lips 7. Depending on the type of preparation agent, the film of preparation agent, some of which is applied to only one side, dries rapidly, so its efficacy remains reduced.

The present inventors have recognized the fact that this problem can be eliminated according to a first embodiment of this invention by subjecting the yarn 4 to a more intense air eddy current in a migration nozzle 10. A double eddy current flow has proven to be optimal, producing a thorough mixing of the preparation agent in the entire yarn composite and at the same time causing the filaments in thread 4' to be crossed. This should prevent the development of intermingling knots (FIG. 6*c*). The yarn is opened due to the double eddy current and the individual filaments are crossed slightly with respect to each other (see FIG. 6*b*).

A migration nozzle 10 is shown again in a sectional view on a larger scale in FIG. 2*a*. The migration nozzle 10 is designed in two parts and consists of an upper cover plate or baffle plate 11 and a bottom nozzle plate 12 with connection 13 for the treatment medium. The medium is guided from connection 13 through a first borehole 14 and a compressed medium feed channel 15 into the yarn channel 16. The direction of introduction is important here and is designated as the angle $\alpha$. The angle $\alpha$ must be greater than 10° to a perpendicular line with respect to the yarn running in yarn channel 16. According to experiments so far, the angle $\alpha$ should be even greater than approximately 15°. A double eddy is produced, as was previously the case, by the angle range from 15°–60°, but at the same time a strong conveyance effect in the yarn transport direction is also achieved. As shown in FIG. 2*a*, the mouth of the compressed medium feed channel 15 is located at the end of approximately the first third of the yarn channel 16, as indicated by X and Y. The free cross section of the yarn channel 16 becomes increasingly larger in the yarn transport direction at the three sections marked by the dimension arrows (beginning of treatment channel A, mouth of air injection B and end of treatment channel C). The size of the narrowest cross section will depend on the titer of the yarn, as is already known to be the case with intermingling nozzles. The area F3 is approximately twice as large as F1, depending on the angle, and F2 is proportional between the two values for F1 and F3 accordingly. In contrast with the preparation stage 2 where a chemical preparation agent (ChPr) is supplied, the migration stage 3 works with a gaseous medium. It may be simply compressed air, heated air or steam, depending on the type of treatment intended. A free distance FA between the preparation device 5 and the migration nozzle 10 is a great advantage for the subsequent installation of a migration nozzle in existing installations. The gaseous medium used with the migration nozzle 10 should at least act dominantly in the yarn transport direction so that the gaseous medium is blown back into the entrance area 20 of the yarn channel 16 as little as possible, which could thus interfere with application of the chemical preparation agent Ch.Pr. As mentioned previously, a relatively low pressure of the treatment gas is needed for migration, and in many applications it may even be approximately 0.3 to 1.5 bar. The baffle face 21 is preferably designed as a flat face, whereas the opposite side 22 (air injection side) is rounded. The width of the channel in the area of the nozzle plate KBD should be at least equal to or greater than the channel width KBP in the baffle plate according to FIG. 2*b*, so that the individual filaments do not stick or catch at the transitions, especially in the area of the threading slot 23, and no corresponding trouble is caused. FIG. 2*c* shows a single yarn treatment nozzle, and FIG. 2*d* shows a double nozzle. The separation T between two adjacent yarn runs is shown in FIG. 2*d*. In many cases it is possible to provide two or more channels which act accordingly instead of just a single compressed medium feed channel 15.

FIGS. 3*a* and 3*b* show a two-part migration nozzle 10 as a sectional view of FIG. 3*c*. FIG. 3*a* shows a section IIIa—IIIa, FIG. 3*b* shows a section IIIb—IIIb of FIG. 3*c*. FIG. 3*c* shows a section III—III of FIG. 3*a*. Migration nozzle 10 consists of a nozzle plate 11 and a cover plate 12. The two parts are rigidly connected by means of a screw 32 (FIG. 3*b*). For accurate positioning, in particular as an assembly aid, nozzle plate 11 and cover plate 12 are each secured with two alignment pins 33, 33' to prevent displacement in a plane (labeled as X-X in FIG. 3*b*) according to arrow 34. The alignment pins 33, 33' shown here have a double function in this example. In addition to positioning the nozzle plate and the cover plate relative to one another, they also serve the function of local fixation of the entire migration nozzle 10 on a mount 35 (not shown). Alignment pins 33, 33' have already been assembled in one of the nozzle parts at the manufacturing plant. It is important here not to rely on a glue connection, a welded connection or a soldered connection but instead the mechanical clamping means yield the required anchoring in the material of the air treatment body. A tension spring or tension ring 36 forms the mechanical clamping means. An undercut of approximately the same shape as the tension means is produced for tension ring 36 adjacent to an insertion cone in the nozzle plate 11. An insertion cone facilitates automatic assembly of the alignment pins. Nozzle plate 11 has two fitting boreholes. The alignment pin can also be inserted by hand into a through-hole 37 (shown with dotted lines) until the tension ring approaches the narrowest passage of the insertion cone. The rest of the movement for insertion of the alignment pin 33 can be accomplished by tapping lightly, e.g., by means of a rubber hammer, so that tension spring 38 springs into the undercut. In the completely assembled state, the alignment pin 33 projects beyond on both sides. The counterpart to nozzle plate 11 is cover plate 12 which has two axially parallel fitting bores at an identical spacing accordingly. The two parts 11, 12 are assembled for the first time at the manufacturing plant. At the user's plant, the parts can be removed in the axial directions of the alignment pins for cleaning the parts after loosening screw 32, for example. Another great advantage of the invention proposed here is that subsequent recycling is improved due to the ease of separation, and each material can be processed separately. This is important because the yarn treatment nozzles are expendable parts.

FIGS. 3*a* and 3*c* show a possible shape of a yarn channel 16 for treatment of yarn with compressed air or steam, where $D_L$ marks the location for a connection for supplying a medium, said medium being introduced into yarn channel 16 at 1 to 10 bar, for example through a feed bore 15. The two alignment pins 33, 33' are preferably arranged together with the screw 32 on a common line 37 (VE). This optimizes the fitting connection and the force connection and allows an especially narrow separation for the yarn running.

The two base bodies of the migration nozzles are made of a highly wear-resistant and very expensive material, especially a ceramic. The boreholes or seats for the clamping means can be produced in a standardized or automated operation with regard to the diameters and diameter ratios. However, the alignment pins can be fabricated as inexpensive parts in various lengths for the respective application.

FIGS. 2*b*, 2*c* and 2*d* and 3*a* through 3*c* are also examples of a thermal treatment in one or two through-flow chambers, especially for treatment of yarn with superheated steam or hot air without any immediately preceding preparation. Each through-flow chamber has a yarn inlet 38, a yarn outlet 39 and a medium feed opening 15 in the middle area. If the medium is superheated steam, at the very high yarn transport speeds in use today, this will yield the disadvantage of extremely corrosive conditions for the yarn which has been treated at some point previously with preparation agents. What is especially interesting in this example is that the two through-flow chambers or steam chambers have a considerable length dimension which is due to the working process, or it must be determined from one case to the next. As shown in FIGS. 2*b*, 2*c* and 2*d*, the yarn treatment body has not only one through-flow chamber but instead has two or more through-flow chambers. With this novel embodiment of the connection means, the two chambers can be constructed especially close to one another. If several parallel yarn runs are needed, this is especially advantageous because this makes it possible to keep the separation T between two adjacent yarn runs extremely small. The alignment pin connection and screw connection are preferably produced on a line 37 parallel to the yarn run and are resistant to preparation agents. The medium supplied through feed opening 15 can leave the through-flow chamber through the yarn inlet 38 and the yarn outlet 39. If only a single treatment position is in use, the quantity of medium is still low and it can flow into the space. However, if multiple steam positions are used in the same room, the steam must be collected from the through chamber and removed, especially when working with superheated steam. Preferably one or more positions are surrounded with a common medium collecting housing. In the case of the thermal treatment, a jet effect should be avoided. Steam may also be supplied through multiple boreholes. It is important to avoid a strong jet effect due to the thermal medium in the thermal treatment, whether the medium is hot air, superheated steam or any hot medium mixture which may also contain preparation agent, for example.

FIGS. 4*a* and 4*b* each show one example of a different angle of widening β of the yarn channel. FIG. 4*a* shows a larger angle β2 of 5–10°. FIG. 4*b* shows an angle of less than 6°. FIG. 5*a* illustrates the possibility of a yarn channel having a constant cross section by using two short parallel lines. FIGS. 5*a* through 5*c* show the basic possibility of adding preparation agent Ch.Pr through a feed channel 6 in a migration nozzle. Preparation agent Ch.Pr is fed directly into yarn channel 16 through a fine bore 40. The preparation agent can be applied directly to the running yarn by stripping accordingly as in the case of the preparation lips. Since there is an enormous variety of different types of preparation agents even with regard to consistency, the specific application of preparation agent must be adapted in special cases. Another possibility is illustrated in FIG. 5*c*, where the preparation agent is introduced into the yarn channel through the borehole 40 in the compressed medium feed channel 15. As in the case of using steam as the treatment medium, it may also be necessary in the case of the solutions to this invention illustrated in FIGS. 5*a*–5*c* to use suction in removing the air coming out. One or more pockets 41 may be provided in the area of the boreholes to achieve a more optimal mixing and application of the preparation agent.

FIG. 6*a* shows a great enlargement of a smooth yarn 4, with the individual filaments running approximately parallel in the thread. Parallel bundling of the filaments has the great disadvantage that, first of all, the thread intermingling is very loose, and secondly, individual filaments can easily become detached from the composite and pose problems in processing. FIG. 6*c* shows as a counterpart a knotted yarn produced in a traditional intermingling nozzle. This shows one knot at the top and one at the bottom, with L indicating a left-hand knot and R indicating a right-hand knot. The knot connection is relatively stable but it can be loosened again by means of strong and repeated jerky pulling on a portion of knotted yarn. Formation of knots presupposes the use of a filament yarn. If the yarn already has half knots and weak knots, then the actual formation of knots in an intermingling nozzle is difficult and is impaired. The novel crossed yarn (FIG. 6*b*) is a yarn pattern between that of the knotted yarn (FIG. 6*c*) and the smooth yarn (FIG. 6*a*). The individual filaments are slightly crossed with respect to one another or, when considered differently, they are blended running in another constellation. Crossing yields a sufficient cohesion so that the composite structure can no longer become loosened in the processing which follows directly. In particular, individual filaments can no longer become separated from the structure. Crossed yarn gives the required security for transport and spooling up or the special treatment stages in subsequent processing as explained below.

FIG. 7*a* shows schematically from lop to bottom a spinning line for POY; FIG. 7*b* shows a spinning line for processing of FDY/FOY as a spinning-drawing line, and FIG. 7*c* shows the use with a spinning-draw texturing line for BCF yarn which has spinning 50, a migration stage 51, a drawing stage 52, a texturizing stage 53 and an intermingling stage 54 with a rinsing station 55 at the bottom. In FIG. 7*a* the drawing and texturing stages are omitted, and in FIG. 7*b* only texturing has been omitted in comparison with FIG. 7*c*. FIGS. 8*a* and 8*b* as well as 9*a* through 9*c* show uses of a migration stage 51 in various spinning operations, with 50 indicating the so-called spinneret or the spinning beam with a connected spinning shaft and the incoming airflow, 2 indicates the preparation stage and 60 shows an automatic yarn-cutting device. Upstream from the spooling stage, intermingling is labeled as 54. The migration stage is 3 and the spooling stages 55. In FIGS. 8*a* and 8*b*, DrTw indicates "draw twisting" and DRW indicates "draw winding" which are performed subsequently. FIGS. 8*a* and 8*b* show an application for POY yarn, but FIGS. 9*a* and 9*c* show an application for FDY yarn. HEAT marks the locations where heat is used.

FIG. 10*a* illustrates a process of technical yarn production, and FIG. 10*b* shows a BCF process.

In FIGS. 8, 9 and 10, the reference number 60 is shown in parentheses, which should indicate that it is possible to use specifically one migration nozzle alone or a combination with a preparation stage or, as a third possibility, a combined nozzle may be used, e.g., according to FIGS. 5*a*–5*c*.

For the design of the cross-sectional shapes, reference is made to the possibilities according to European Patent 564,400, European Patent 465,407 or U.S. Pat. No. 5,010, 631, for example.

What is claimed is:

1. A method of treating filament yarn comprising:

supplying a plurality of yarn filaments through a yarn channel of a nozzle in a yarn travel direction; and introducing a blowing medium into the yarn channel substantially in a direction of the yarn travel direction and at an angle of introduction of more than about 15° and less than about 45° from a direction perpendicular to the yarn travel direction, wherein the plurality of yarn filaments are mixed within the yarn channel so as to produce a filament yarn substantially free of knots.

2. The method of claim 1, further comprising adding a preparation agent to at least some of the plurality of yarn filaments.

3. The method of claim 2, wherein adding the preparation agent includes adding the preparation agent prior to introducing the blowing medium into the yarn channel.

4. The method of claim 2, wherein adding the preparation agent includes adding the preparation agent to the yarn channel via the blowing medium.

5. The method of claim 4, wherein adding the preparation agent includes introducing the preparation agent into the blowing medium at a location at which the blowing medium enters the yarn channel.

6. The method of claim 4, wherein adding the preparation agent includes introducing the preparation agent into the blowing medium at a location prior to the blowing medium entering the yarn channel.

7. The method of claim 2, wherein adding the preparation agent includes adding the preparation agent to the yarn channel at a location either downstream or upstream from a location at which the blowing medium enters the yarn channel.

8. The method of claim 1, wherein the blowing medium is compressed air having a pressure of less than about 6 bar.

9. The method of claim 1, wherein introducing the blowing medium includes introducing the blowing medium into a first half of the yarn channel as measured from a location where the plurality of yarn filaments enter the yarn channel.

10. The method of claim 1, wherein introducing the blowing medium includes introducing the blowing medium into a first third of the yarn channel as measured from a location where the plurality of yarn filaments enter the yarn channel.

11. The method of claim 1, wherein introducing the blowing medium includes aiming the blowing medium substantially at a center line of the yarn channel.

12. The method of claim 1, wherein the blowing medium is compressed air having a pressure of less than about 1.5 bar.

13. The method of claim 12, wherein introducing the blowing medium includes introducing the blowing medium at an angle of introduction ranging from about 15 degrees to about 30 degrees from the direction perpendicular to the yarn travel direction.

14. The method of claim 1, wherein the blowing medium is steam having a pressure of ranging from between about 4 bar to about 10 bar.

15. The method of claim 14, wherein introducing the blowing medium includes introducing the blowing medium at an angle ranging from about 25 degrees to about 45 degrees from the direction perpendicular to the yarn travel direction.

16. The method of claim 1, further comprising performing a filament spinning operation on the plurality of yarn filaments.

17. An apparatus for treating filament yarn, comprising:

a nozzle defining a yarn channel configured to receive a plurality of yarn filaments and a compressed medium feed channel opening into the yarn channel and oriented so as to introduce medium into the yarn channel approximately in a direction of yarn travel through the yarn channel, wherein the compressed medium feed channel is disposed at an angle of greater than about 20 degrees and less than about 45 degrees from a direction perpendicular to the direction of yarn travel or to a longitudinal center axis of the yarn channel.

18. The apparatus of claim 17, wherein the yarn channel widens at an angle ranging from about 0 degrees to about 10 degrees from the yarn travel direction of the plurality of yarn filaments.

19. The apparatus of claim 17, wherein the nozzle includes a nozzle plate and a baffle plate.

20. The apparatus of claim 19, further comprising a threading slot extending approximately a length of the yarn channel.

21. The apparatus of claim 20, wherein the threading slot is disposed in a plane of separation between the nozzle plate and the battle plate.

22. An apparatus for treating filament yarn, comprising:

a nozzle defining a yarn channel configured to receive a plurality of yarn filaments and a compressed medium feed channel opening into the yarn channel and oriented so as to introduce medium into the yarn channel approximately in a direction of yarn travel through the yarn channel, wherein the compressed medium feed channel is disposed at an angle of greater than about 15 degrees and less than about 45 degrees from a direction perpendicular to the direction of yarn travel or to a longitudinal center axis of the yarn channel, wherein the yarn channel widens at an angle ranging from about 1 degree to about 6 degrees from the yarn travel direction of the plurality of yarn filaments.

23. An apparatus for treating filament yarn, comprising:

a nozzle defining a yarn channel configured to receive a plurality of yarn filaments and a compressed medium feed channel opening into the yarn channel and oriented so as to introduce medium into the yarn channel approximately in a direction of yarn travel through the yarn channel, wherein the compressed medium feed channel is disposed at an angle of greater than about 15 decrees and less than about 45 degrees from a direction perpendicular to the direction of yarn travel or to a longitudinal center axis of the yarn channel, wherein the nozzle comprises a plurality of nozzles.

24. An apparatus for treating filament yarn, comprising:

a nozzle defining a yarn channel configured to receive a plurality of yarn filaments and a compressed medium feed channel opening into the yarn channel and oriented so as to introduce medium into the yarn channel approximately in a direction of yarn travel through the yarn channel; and a feed bore configured to introduce a preparation agent into the yarn channel, wherein the compressed medium feed channel is disposed at an angle of greater than about 15 degrees and less than about 45 degrees from a direction perpendicular to the direction of yarn travel or to a longitudinal center axis of the yarn channel.

25. An apparatus for treating filament yarn, comprising:

a nozzle defining a yarn channel configured to receive a plurality of yarn filaments and a compressed medium feed channel opening into the yarn channel and oriented so as to introduce medium into the yarn channel approximately in a direction of yarn travel through the yarn channel; and a feed bore configured to introduce a preparation agent into the compressed medium feed channel, wherein the compressed medium feed channel is disposed at an angle of greater than about 15 degrees and less than about 45 degrees from a direction perpendicular to the direction of yarn travel or to a longitudinal center axis of the yarn channel.

26. The apparatus of claim 25, further comprising at least one pocket disposed in the yarn channel, and substantially opposite to the feed bore, wherein the pocket is configured to assist the feed bore in introducing the preparation agent.

27. An apparatus for treating filament yarn, comprising:

a nozzle defining a yarn channel configured to receive a plurality of yarn filaments and a compressed medium feed channel opening into the yarn channel and oriented so as to introduce medium into the yarn channel approximately in a direction of yarn travel through the yarn channel, wherein the compressed medium feed channel is disposed at an angle of greater than about 15 degrees and less than about 45 degrees from a direction perpendicular to the direction of yarn travel or to a longitudinal center axis of the yarn channel, wherein the apparatus is configured to slightly cross the plurality of yarn filaments and to produce a filament yarn substantially free of knots.

* * * * *

UNITED STATES PATENT AND TRADEMARK OFFICE

CERTIFICATE OF CORRECTION

PATENT NO. : 6,834,417 B1
DATED : December 28, 2004
INVENTOR(S) : Patrick Buchmüller It is certified that error appears in the above-identified patent and that said Letters Patent is hereby corrected as shown below:

Title page,
Item [57], ABSTRACT,
Line 9, “knits.” should read -- knots. --.

Column 12,
Line 12, “battle” should read -- baffle --.

Signed and Sealed this

Nineteenth Day of April, 2005

JON W. DUDAS
*Director of the United States Patent and Trademark Office*